US005853037A

United States Patent [19]

Moser

[11] Patent Number: 5,853,037

[45] Date of Patent: Dec. 29, 1998

[54] RECTILINEAR CROSS-SECTIONAL BEAM FURNITURE, FURNITURE DESIGN AND FURNITURE PRODUCTION

[76] Inventor: Thomas F. Moser, Dingley Island Rd., Brunswick, Me. 04011

[21] Appl. No.: 498,956

[22] Filed: Jul. 6, 1995

[51] Int. Cl.[6] ..... B27M 1/00; B27B 1/00; A47C 7/02

[52] U.S. Cl. ..... 144/329; 144/3.1; 144/345; 144/354; 144/356; 29/428; 297/452.18

[58] Field of Search ..... 29/428, 453; 294/452.18; 52/782.2, 783; 144/3.1, 134.1, 137, 344, 345, 347, 354, 356, 357

[56] References Cited

U.S. PATENT DOCUMENTS 3,662,798 5/1972 Campbell ..... 144/356
4,149,089 4/1979 Idelsohn et al. ..... 144/356
4,399,849 8/1983 Nowakowski ..... 144/356
5,359,944 11/1994 Steinbeck ..... 52/783

*Primary Examiner*—W. Donald Bray
*Attorney, Agent, or Firm*—Kilpatrick Stockton LLP; John S. Pratt

[57] ABSTRACT

A furniture design and manufacturing system utilizing initial selection of a design "vocabulary" of rectilinear cross-sectional shape "beams" that integrate structural and aesthetic considerations, and utilizing panels coordinated in thickness to be received in dados and rabbets in the beams. Beam cross sections generally have a predetermined incremental size difference, or multiple of the incremental size difference, so that beams inter-fit and cooperate with panels and other beams in a graduated manner permitting a sort of "nesting" when beams, or panels and beams, are used together. This facilitates joinery in furniture using such components because, among other reasons, mortises tend to fall in thicker components than those having tenons. Production of beam stock and, if desired, panel production precedes identification of a furniture item to be produced, facilitating economies in production.

11 Claims, 8 Drawing Sheets

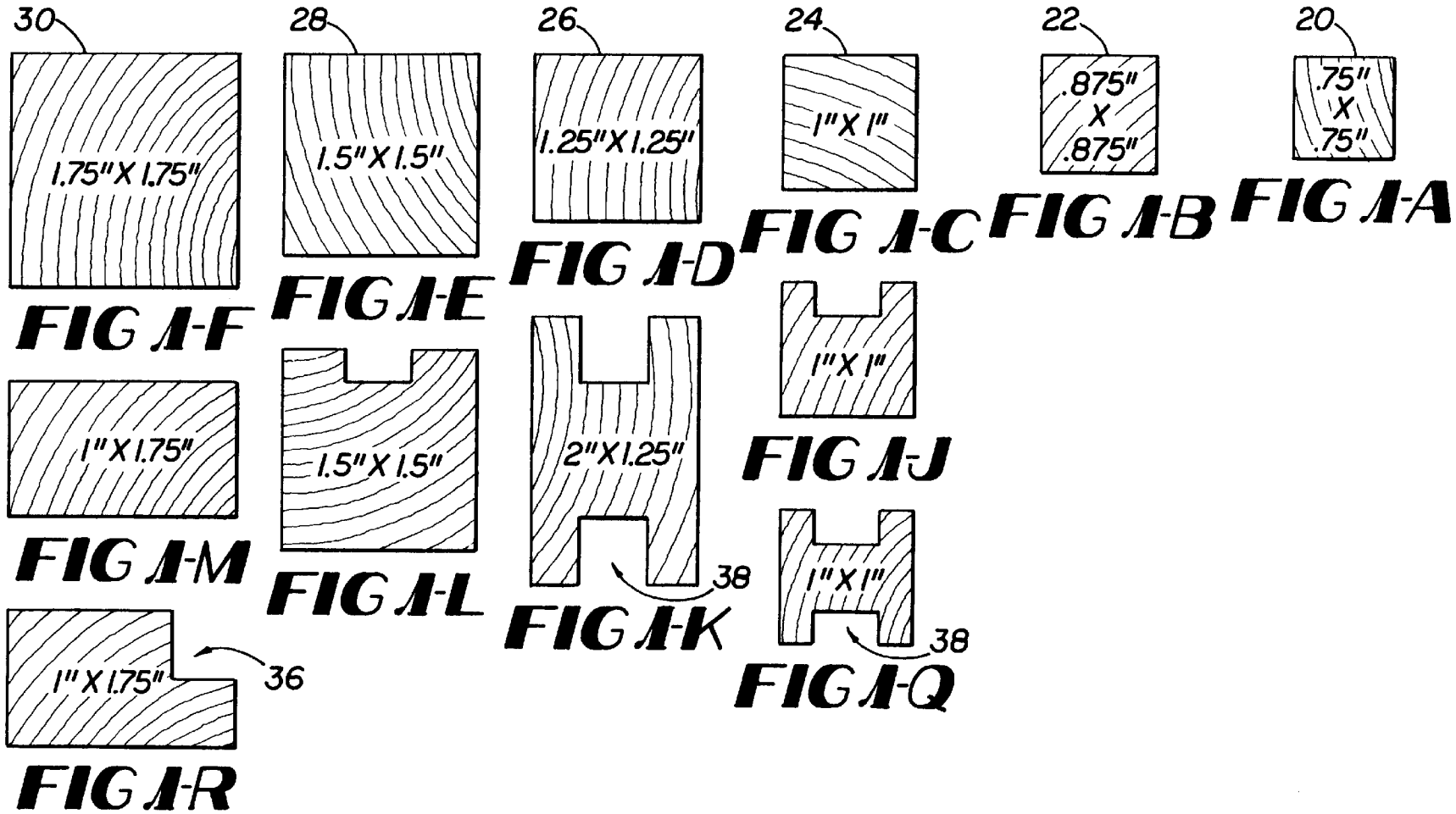
20
.75" X .75"
FIG A-A
22
.875" X .875"
FIG A-B
24
1" X 1"
FIG A-C
26
1.25" X 1.25"
FIG A-D
28
1.5" X 1.5"
FIG A-E
30
1.75" X 1.75"
FIG A-F
1" X 1"
FIG A-J
2" X 1.25"
38
FIG A-K
1.5" X 1.5"
FIG A-L
1" X 1.75"
FIG A-M
1" X 1"
38
FIG A-Q
36
1" X 1.75"
FIG A-R

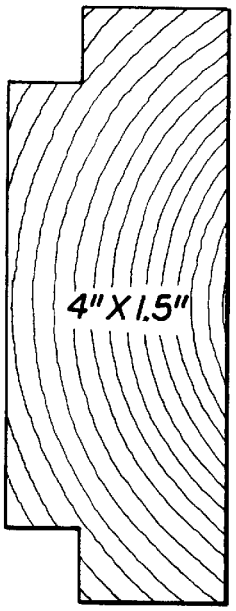
FIG A-H
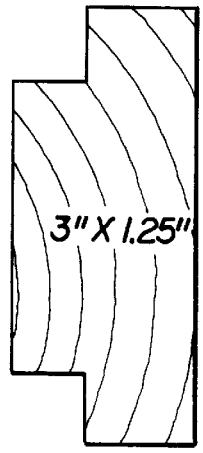
FIG A-P
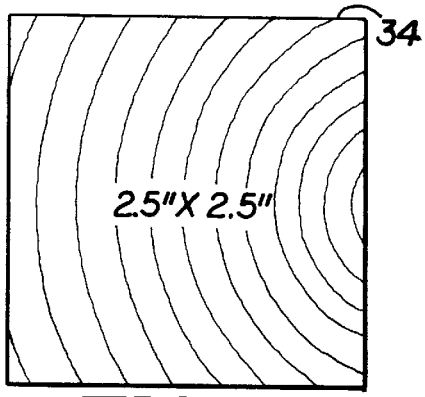
FIG A-H
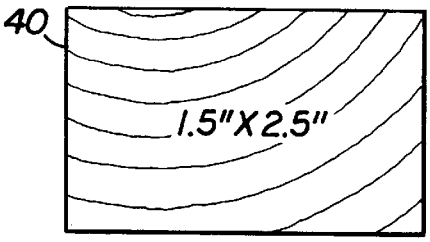
FIG A-O
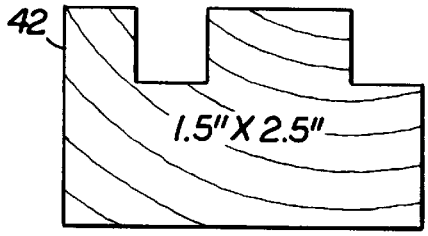
FIG A-U
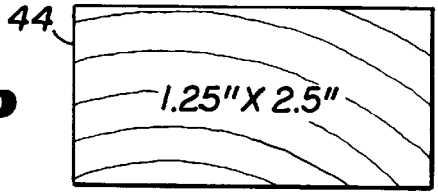
FIG A-W
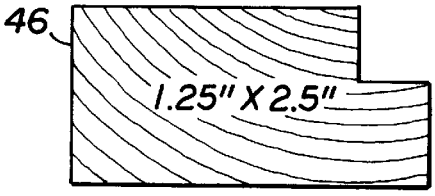
FIG A-Y
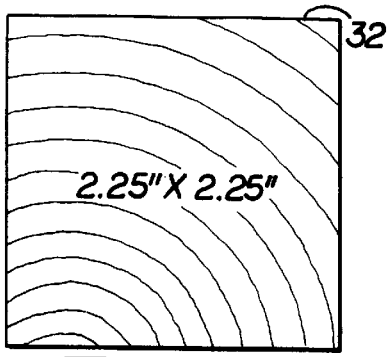
FIG A-G
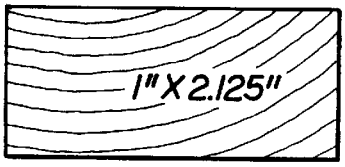
FIG A-N
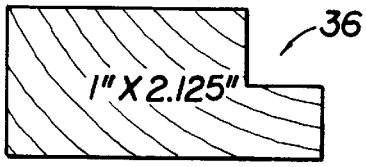
FIG A-S
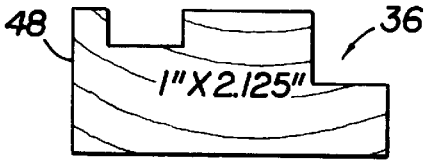
FIG A-T
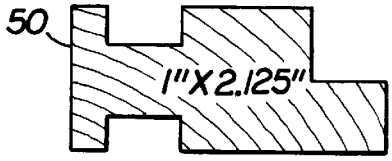
FIG A-V
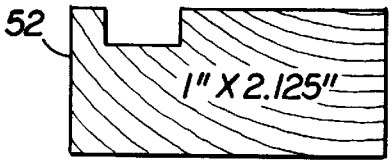
FIG A-X
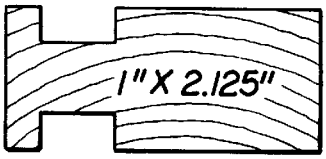
FIG A-Z

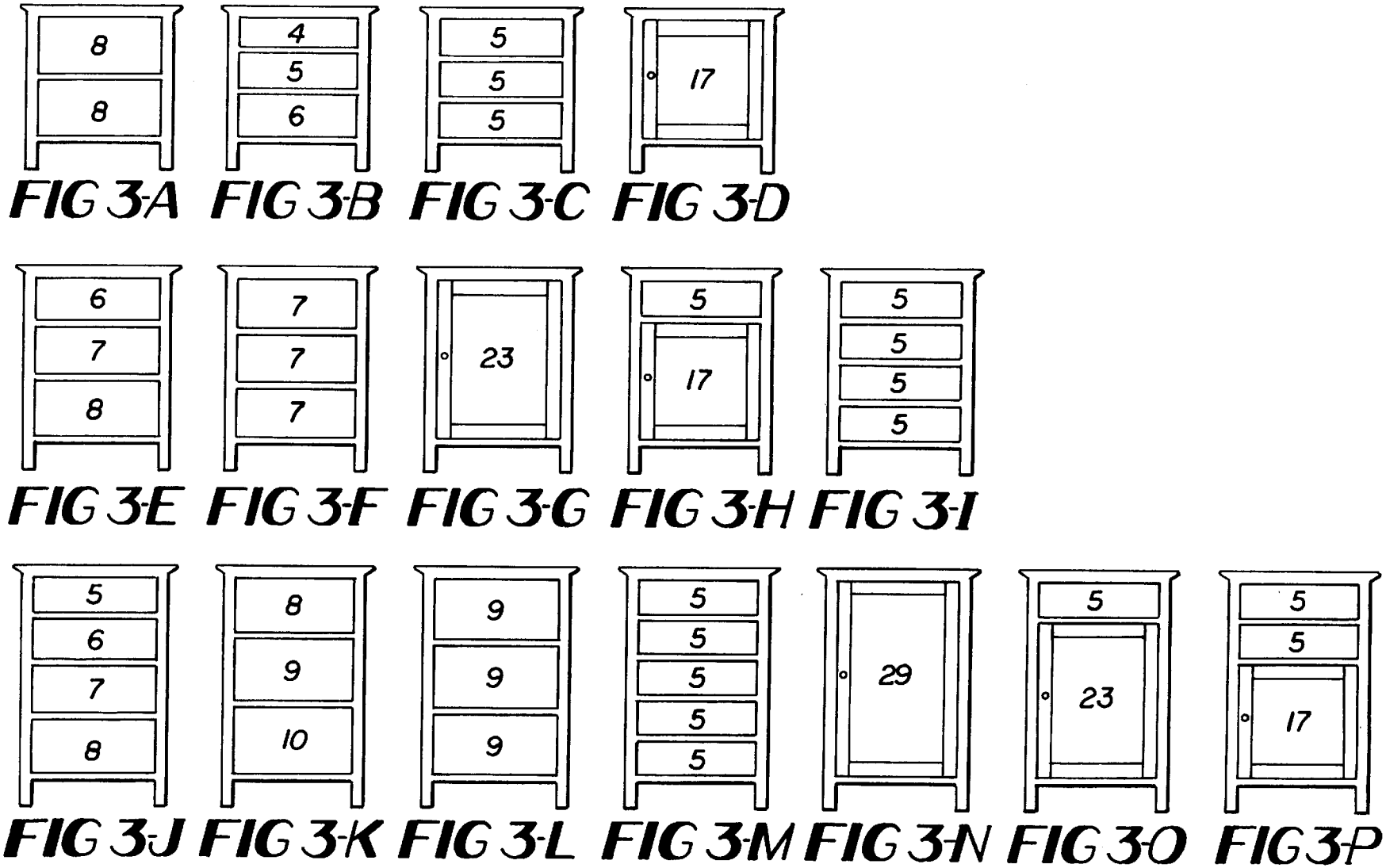
FIG 3-A FIG 3-B FIG 3-C FIG 3-D
FIG 3-E FIG 3-F FIG 3-G FIG 3-H FIG 3-I
FIG 3-J FIG 3-K FIG 3-L FIG 3-M FIG 3-N FIG 3-O FIG 3-P

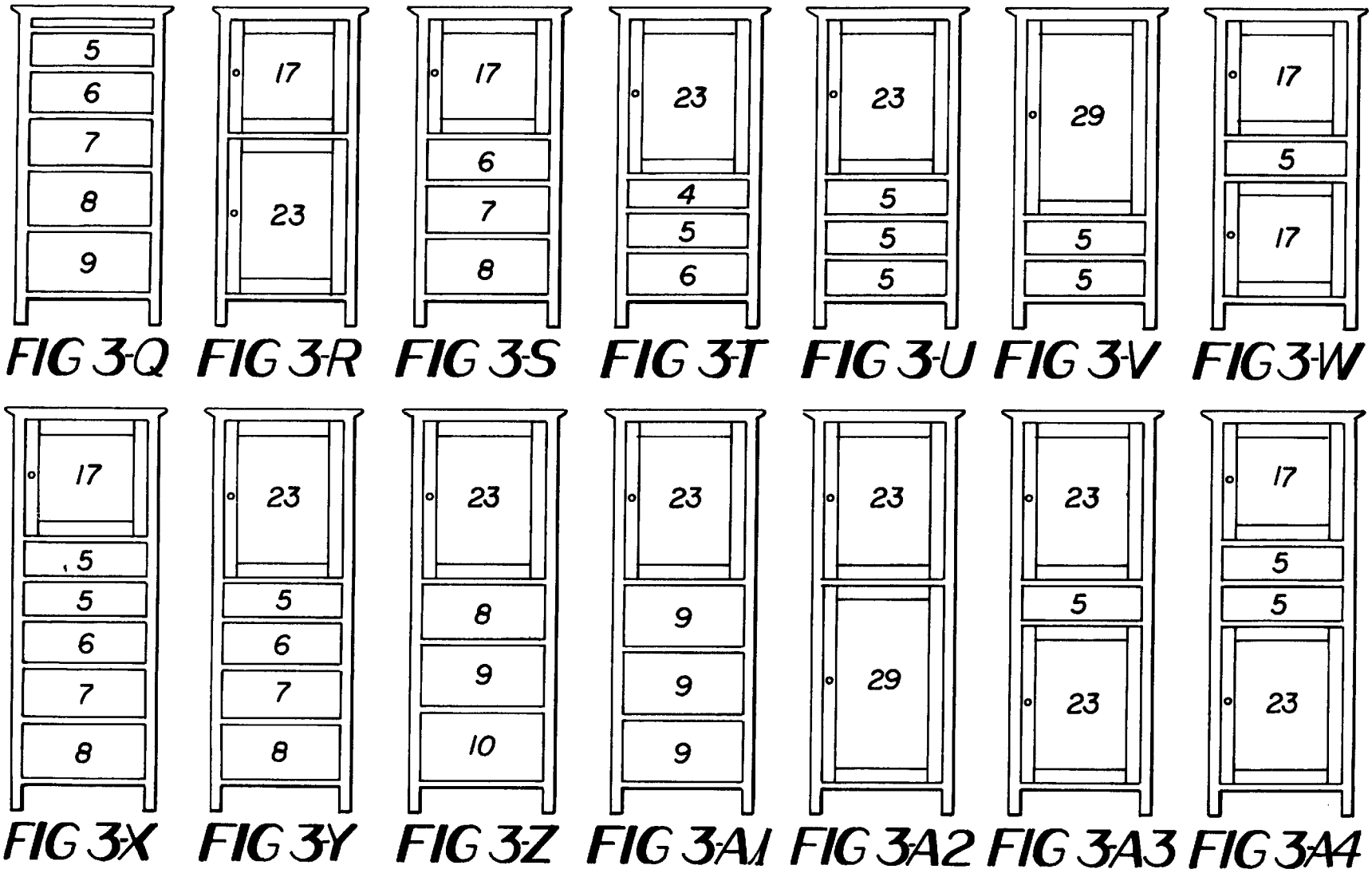
5 6 7 8 9
FIG 3-Q
17 23
FIG 3-R
17 6 7 8
FIG 3-S
23 4 5 6
FIG 3-T
23 5 5 5
FIG 3-U
29 5 5
FIG 3-V
17 5 17
FIG 3-W
17 5 5 23
FIG 3-A4
23 5 23
FIG 3-A3
23 29
FIG 3-A2
23 9 9 9
FIG 3-A1
23 8 9 10
FIG 3-Z
23 5 6 7 8
FIG 3-Y
17 5 5 6 7 8
FIG 3-X

RECTILINEAR CROSS-SECTIONAL BEAM FURNITURE, FURNITURE DESIGN AND FURNITURE PRODUCTION

FIELD OF THE INVENTION

This invention relates to the design and production of furniture.

BACKGROUND OF THE INVENTION

Furniture is one of the oldest classes of human-made objects. Furniture has been produced utilizing virtually every type of natural and synthetic material known; however, among the most frequently and longest-used materials for furniture construction is wood.

Wood has been used in furniture and a wide variety of other applications throughout history because of its extraordinary properties of strength and beauty. It is not, however, a particularly easy material to use and must be well understood, and incorporated in careful designs, for successful exploitation of its beauty and capacity for durability.

Notwithstanding the long, virtually world-wide use of wood in the construction of furniture, problems continue to be associated with the use of this material and design of furniture employing it. Furthermore, construction of furniture from wood, particularly solid wood, continues to be a labor-intensive activity, with the result that high-quality furniture products are quite expensive.

Even with widespread use of highly automated machinery in the production of furniture components, conventional furniture designs require substantial quantities of hand labor. Additionally, the enormous variety of furniture designs and sizes of furniture pieces of particular designs demand equally substantial numbers of different components, frequently sized to be usable solely in a single piece of furniture.

While furniture has been designed using countless approaches, most of those approaches have involved the identification of overall form, or the definition of function followed by the identification of form, and then the design of components of that form. In these conventional approaches components tend to be quite specific to particular furniture forms (such as a particular chair, bed or chest of drawers design), and aesthetic considerations often dominate structural considerations. Expressed differently, appearance considerations are often substantially separate from engineering considerations, in the conventional design of furniture components.

While not normally thought of in the same way as freestanding furniture, cabinets, particularly kitchen cabinets, have frequently been designed after specifying certain standard measurement parameters. For instance, many conventional cabinets have been designed in two inch incremental widths and are designed to have a standard counter height such as thirty inches. More recently, face-frameless or "European" style cabinets have been designed around a 32 millimeter increment for certain measurements. In both types of cabinets, design proceeds from definition of function and identification of overall form to the design of components, and most or all components are produced from man-made sheet materials.

SUMMARY OF THE INVENTION

The present invention overcomes certain limitations inherent in previous furniture design and manufacturing techniques, making possible design and construction of an enormous variety of aesthetically pleasing, high-quality, case goods and seating furniture products. Such products can be built with desirably low expenditures of labor, particularly in the manufacture of components, and with the manufacture of standardized components usable in a very wide variety of furniture product designs and sizes.

Furniture Design Vocabulary and System

The furniture design and manufacturing system of the present invention starts not with the design of particular furniture forms but with the selection of a design "vocabulary" of rectilinear cross-sectional shape "beams" that integrate structural and aesthetic considerations, and with the design of panels coordinated in thickness to be received in dados and rabbets in the beams.

As used herein, a "rectilinear" shape is one formed by substantially straight lines that meet at right angles. Small edge or arris chamfers are generally ignored in this definition. However, as will be understood by those skilled in the art, the longitudinal arris formed at the intersection of two planes in a beam of the present invention typically will be "eased," "rounded over" or chamfered. By contrast, an arris at the end of a beam that has been machined to length and which is to abut another beam or other furniture member typically will not be eased, rounded over or chamfered so that the faces of the beam will squarely meet the faces of the beam or other member they abut.

The term "beam" is used here as defined by *The Random House Dictionary of the English Language* (2nd Ed. 1987): "1. any of various relatively long pieces of metal, wood, stone, etc., manufactured or shaped esp. for use as rigid members or parts of structures or machines." As will be further described below, the "beams" of the present invention are generally single pieces of solid wood, although they can be laminated from multiple layers of solid wood to form curved beams. The beams of the present invention can be joined with other members, such as beams and panels, to form load bearing structures, here called "girders," that function similarly to metal "I-beams" and "H-beams" in that a web separates two plates, one of which is in tension and the other of which is in compression when a lateral load is applied.

"Beams" in furniture designed in accordance with the present invention are members that typically have a substantially greater length than the beam's greatest cross-sectional dimension. Generally such beams are joined at or near both ends in assembled furniture. The beams of the present invention provide rigidity and other structural contributions at the same time that they are prominent visual elements; thus they are simultaneously structural and aesthetic elements of the furniture constructed from them.

Contrary to typical engineering usage of the term, the beams of the present invention may be vertical as well as horizontal; for instance, some beams serve as posts or legs.

As will be further described and explained below, and as will be apparent to those skilled in the art, some of the beams of the present invention can simultaneously serve multiple functions. For instance, one beam can simultaneously act as a horizontal load bearing member, divide space visually, act as case joinery, and serve as a drawer runner.

Unlike many styles of furniture, the furniture of the present invention typically has essentially no applied ornamental elements such as applied moldings, applied carvings, or the like. Applied or worked ornamental elements may be utilized, or course, and the examples illustrated herein and described below generally do include molded edges worked into the tops of case goods.

Variations between and from solely planar surfaces, which are one of the principal techniques of ornamentation or decoration in traditional furniture, are achieved in the furniture of the present invention essentially solely in the production of beam stock and the arrangement, and non-co-planar intersections, of beams and panels.

Different beam lengths generally are related by a predetermined increment, such as six inches. In practice, beam length incremental dimensions are selected by reference, for instance, to sizing arrays that may be produced for basic elevational views (or sides) of case goods. Beam length increments determine the possible sizes of panels, and knowledge of possible beam lengths from sizing arrays facilitates production of beam stock with minimal waste.

Beam cross sections generally have a predetermined incremental size difference, or multiple of the incremental size difference, so that beams inter-fit and cooperate with panels and other beams in a graduated manner permitting a sort of "nesting" when beams, or panels and beams, are used together. This facilitates joinery in furniture using such components because mortises tend to fall in thicker components than those having tenons.

It is virtually impossible to manufacture furniture joints so that adjacent pre-sanded or pre-machined surfaces will align perfectly in the same plane after assembly. Accordingly, further sanding or other machining of the surfaces intended to be co-planar adjacent to such joints is required. Graduated or nested beam intersections avoid this problem because modest misalignment of joints so designed does not matter since most such joints do not have flush adjacent (visible) surfaces. This design also contributes to visually pleasing beam intersections with attractive shadow-lines and tends to predetermine the visual weight as well as the structural strength of various components.

Panels used in practicing the present invention may be manufactured of solid wood or a variety of other materials and may be flat, fielded or have other shapes. In preferred embodiments of the present invention, panels are flat, however, so that panel stock can be manufactured without knowing the dimensions of panels ultimately to be cut from such stock.

If panels float within their associated frames, as is typical in conventional furniture using solid wood panels, they provide little, if any, structural contribution to the strength of the furniture product. Appropriately manufactured panels may, however, be fixed within the frames as, for instance, by gluing their edges within dados or rabbets in the beams. This construction permits the panels to serve as structural members of the furniture, frequently contributing enormously to strength by providing an element that functions like the web in an I-beam or H-beam.

In accordance with these considerations, practice of the preferred embodiment of the present invention involves selection of panel types and thickness or thicknesses.

Production of Beam Stock and Panel Stock

After design of the beam cross sections, but not necessarily after furniture to be produced has even been identified or designed, "beam stock" is produced in random lengths of the various previously determined cross sectional shapes. Beam stock of the present invention is typically, but not necessarily, machined from solid wood. Beam stock could, for instance, be extruded from metal, plastics or composite materials; molded from such materials; or laminated from solid wood, plastic or composite layers.

Solid wood beam stock of the present invention can be very rapidly, economically, and accurately produced on modern wood molders in random lengths, and beam stock can be completely finish sanded before beams are cut from it. Alternatively, finish sanding may occur after storage and before cutting to length. As a further and generally more preferable alternative, utilizing modern, high speed molders with appropriate custom-made knives and slow stock feed rates, solid wood beam stock can be produced that does not have machine marks and that does not need surface or corner sanding or other abrasive machining. It is also possible to apply finish to beam stock at the time of its manufacture.

Because such random length beam stock can be manufactured for use prior to identification of the furniture to be built from it and stored in a very small volume of space, it is highly desirable to manufacture such beam stock in large production runs, with associated economies, and store it for future use. While all beam stock can be manufactured and stored in random lengths, significant economies may be achieved by machining some beam stock to finished length and maintaining those lengths in inventory. For instance, numerous case goods items in a particular line will have the same depth front-to-back. Thus, beams that establish a commonly-used front-to-back depth in case goods items can be pre-machined to length and stored for future use.

After selection of the panel thickness(s) and determination of panel size incremental dimensions, but not necessarily after selection or identification of a particular item of furniture to be manufactured, panel stock may be constructed in the appropriate thickness(s) and in incremental size dimensions to minimize waste.

Alternatively, panel production may await production of the item of furniture.

Panel stock for panels that may be glued in place and serve as structural members in certain applications may be made of wood by sandwiching strips of hardwood between wood veneer, thereby creating solid-core plywood. Additionally, various other types of conventional and custom man-made panel stock may also be used in practicing the present invention. If desired, panel stock may be partially or fully finished before storage or before such stock is cut into finished panel sizes.

Design of Particular Furniture Items and Sizing Arrays

At any convenient time after creation of the design vocabulary, particular types of furniture items may be designed by the selection of appropriate beam cross-sections. For instance, a certain arrangement of beams may be selected for use as the front of a case goods item. Another arrangement of beams may be selected for use as a sofa and another arrangement for use as a small table.

Alternative sizes of such items may be envisioned by creation of a sizing array in which height and width dimensions are incrementally varied. Thus, several chests of equal width (and different heights) may be envisioned, or several chests of equal height (and different widths) may be designed, all using beams having the same cross-sectional shapes and arranged in the same manner.

Identification of Furniture Item to Be Produced and Determination of Beams and Panels Needed After a particular furniture item and item size to be produced is identified or selected, the cross-sectional beam shapes and lengths, and panel sizes needed, to produce the item are determined and, typically, a cutting list is prepared.

Component Manufacture and Assembly

Beams determined to be needed to manufacture the selected furniture item are produced by selecting random-length beam stock having with the desired cross-sectional shapes from storage and cutting appropriate lengths from such stock. The beams are then machined to produce desired tenons, mortises or other joint members depending on the joinery system in use. For instance, in appropriate circumstances, dowel or compressed wood biscuit joints (or perhaps even metal fasteners) might be used as alternatives to mortise and tenon joints.

Machining of tenons can be accomplished, for instance, on single or double end tenoners, and mortises may be machined on mortising machines. Other joint components or component-receiving recesses can also be machined on conventional equipment.

Panels determined to be needed to manufacture the selected furniture item are produced by selecting random-size panel stock having appropriate thickness from storage and cutting appropriate sizes of panels from such stock or by otherwise producing the panel sizes needed. If pre-finishing is desired and has not previously occurred, the panels may be pre-finished.

The beams and panels are then assembled into the selected item of furniture, typically by capturing panels within dados and rabbets in the beams as beam joints are formed.

Tops of tables and case goods may be produced from beam and panel components in accordance with the present invention, may be of conventional solid construction or may be produced by a variety of other approaches. Likewise cabinet doors in case goods designed and produced in accordance with the present invention may be produced using the same approach or may be of conventional construction.

Practice of the present invention, in which significant aspects of structural and aesthetic design occur prior to design or selection of a particular item of furniture, permits economies in the production of high quality furniture. It also results in a design vocabulary that significantly simplifies the furniture design process and facilitates the design of a wide variety of very attractive, easily manufactured furniture items in a common vocabulary that communicates a unified, identifiable style across an enormous variety of types and sizes of particular furniture pieces.

Practice of the present invention also permits the storage of substantial quantities of partially-manufactured and, if desired, pre-finished furniture materials in very small areas.

Furthermore, the present invention allows the alteration of storage and work flow practices in the manufacture of furniture by shifting a significant portion of the furniture production process into the high volume, low skill manufacture of beam and panel stock and by permitting the storage of such beam and panel stock rather than rough lumber. Additional benefits result from the reduction of dimensional changes due to seasonal aging during storage and the design of beam intersections to reduce manufacturing defects.

These and other benefits of practice of the present invention will be more fully appreciated by reference to the attached drawings, the following descriptions of those drawings, and the claims.

BRIEF DESCRIPTION OF THE DRAWINGS

FIGS. 1-A–1-Z are cross-sections of a collection of graduated or incrementally-dimensioned furniture component beams designed in accordance with the present invention.

FIGS. 3-A–3-A4 are a constellation of equal-width, incrementally dimensioned-height case goods front elevations shown with various combinations of door and drawer fronts in accordance with the present invention.

DETAILED DESCRIPTION OF THE DRAWINGS

Figure 2:
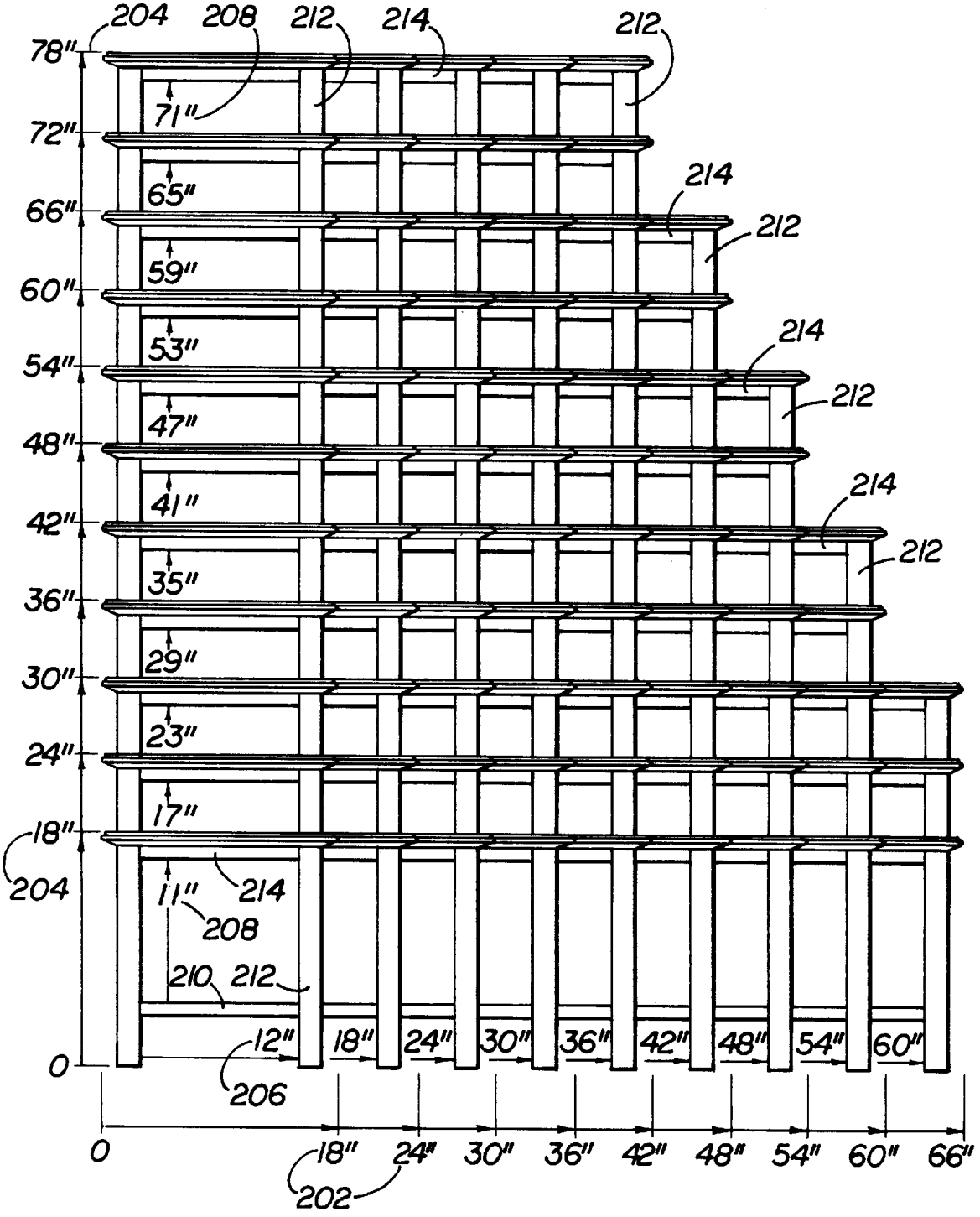
FIG. 2 is a case goods sizing array showing incremental beam length dimensioning in accordance with the present invention.

More detailed understanding of the present invention is facilitated by reference to FIGS. 1-A to 1-Z, which illustrate twenty-six cross-sections in a group of graduated or incrementally-dimensioned beams. For both aesthetic and functional reasons, the beam stock of the present invention is manufactured in graduated cross-sectional sizes generally having a predetermined incremental size difference, or multiple of the incremental size difference.

For instance, the smallest component, beam section 20 in FIG. 1-A, may be 0.75 (¾) inches square, and other components may differ in increments of 0.125 (⅛) inch or multiples thereof so that, for instance, there are square components having sides of 0.75 (¾) inches (beam section 20 in FIG. 1-B), 0.875 (⅞) inch (beam section 22 in FIG. 1-B), 1 inch (beam section 24 in FIG. 1-C), 1.25 (1-¼) inches (beam section 26 in FIG. 1-D), 1.5 (1-½) inches (beam section 28 in FIG. 1-E), 1.75 (1-¾) inches (beam section 30 in FIG. 1-F), 2.25 (2-¼) inches (beam section 32 in FIG. 1-G), 2.5 (2-½) inches (beam section 34 in FIG. 1-H), and so forth.

Other, non-square cross-section beam stock has rectangular cross-sections of the same typical increments and increment multiples and rectangular cross-sections with portions removed, such as rectangular and square rabbets 36 (in FIGS. 1-N, 1-S, and 1-R) and dados 38 (in FIGS. 1-K and 1-Q), also of the same incremental dimensions. For instance, rabbets 36 will typically be 0.5 (½) inches deep and 0.5 (½) inches wide, and dados 38 might typically be 0.5 (½) inches wide and either 0.5 (½) or 0.25 (¼) inches deep.

Some of the square beam sections members have a side dimension that (1) defines the longer side of a family of rectangular cross-section beam sections or (2) is longer than the greater side of a family of rectangular beam sections members by one of the predetermined increments. As an example of the first situation beam section 34 in FIG. 1-H is square, 2.5 (2-½) inches on a side, and the greater dimension of beam sections 40, 42, 44, and 46 (FIGS. 1-0, 1-U, 1-W and 1-Y) is also 2.5 (2-½) inches. As an example of the second condition, beam sections 48, 50, 52 and 54 (FIGS. 1-T, 1-V, 1-X and 1-Z) have longer dimensions of 2.125 (2-⅛) inches (ignoring dados and rabbets), which are smaller than the side dimension of beam section 32 in FIG. 1-G by 0.125 (⅛) inches.

FIG. 2 is a case goods sizing array showing incremental beam length dimensioning in accordance with the present invention. It is used, for instance, as follows. If it is desired to build a small chest of drawers like that illustrated in FIG. 5, an appropriate width 202 such as forty-two (42) inches and an appropriate height 204, such as thirty (30) inches, might be chosen by reference to the sizing array in FIG. 2. These selections will make it readily apparent that the total width 206 between the legs 212 available for drawers in the chest of drawers will be thirtysix (36) inches and the total height 208 available for drawers in the chest of drawers between top (rail) beam 214 and lower (rail) beam 210 will be twenty-three (23) inches.

The incremental, predetermined dimensions displayed in the sizing array facilitate rapid design of case goods and rapid manufacture since the lengths of beams needed to produce items of chosen dimensions have been predetermined. For instance, beam lower (rail) 210 must be thirty-six (36) inches in length plus the length of any tenons.

Figure 5:
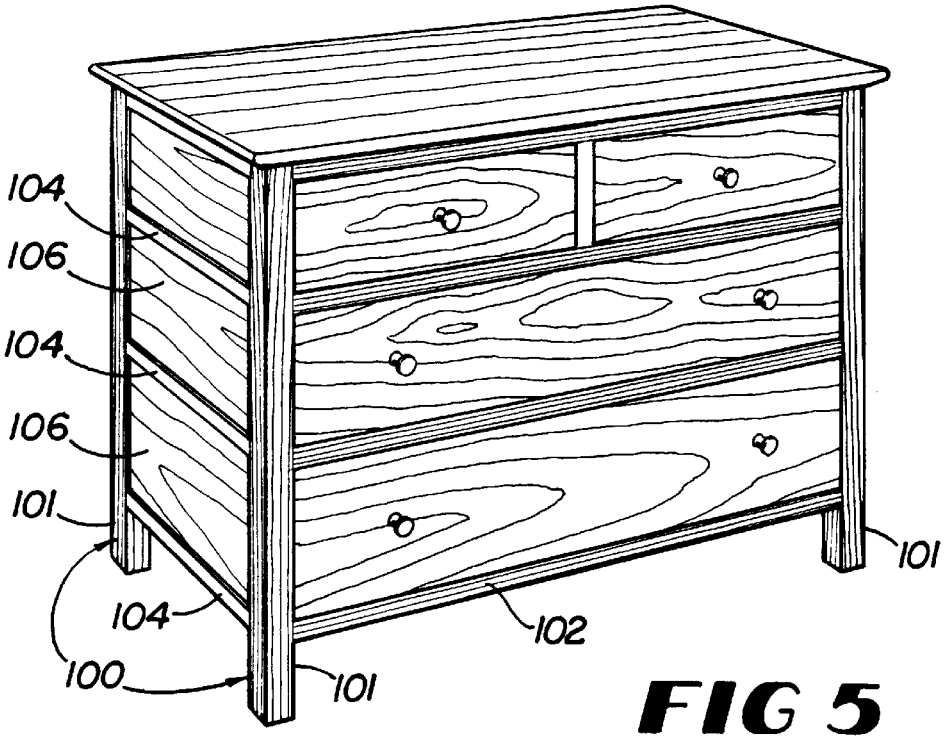
FIG. 5 is a perspective view of the front, left side and top of a chest of drawers designed in accordance with the present invention.

As would be readily understood by one skilled in the art, a sizing array like the one shown in FIG. 2 is useful not only in making sizing and design choices about the front elevation of an item of case goods such as the chest of drawers shown in FIG. 5, but also about the end elevations of such items.

FIGS. 3-A–3-AD show a substantial variety of equal-width, incrementally dimensioned-height case good front elevations with various combinations of spaces that typically correspond to door and drawer fronts. These figures illustrate the enormous variety of interior or front elevation detailing possible while utilizing a very limited number of different components.

The numerals appearing within the various sub-divisions of spaces in FIGS. 3-A–3-AD indicate units of height, such as inches, and again illustrate the enormous flexibility afforded by utilization of the design approach of the present invention.

Figure 4:
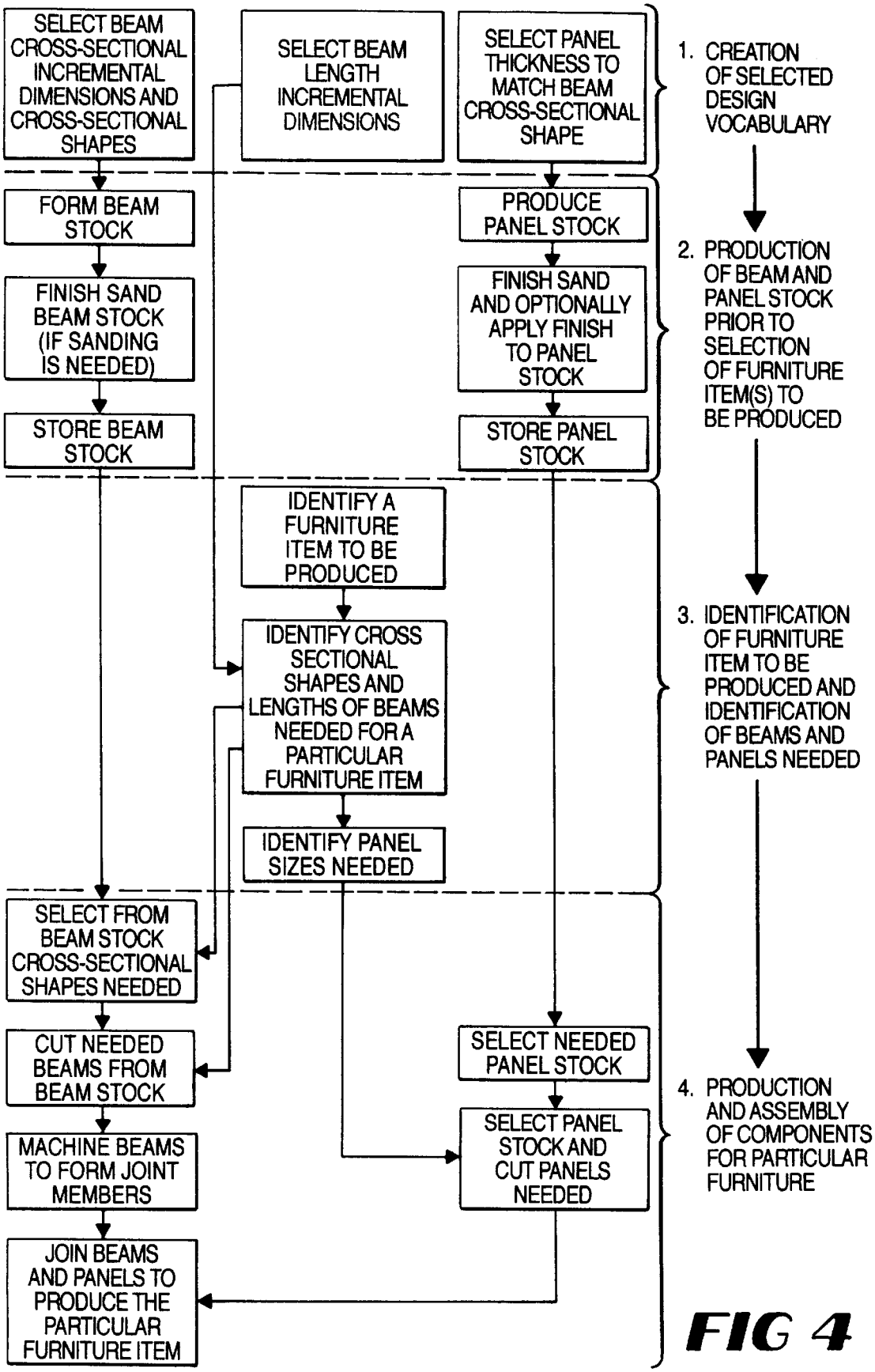
FIG. 4 is a flow diagram and matrix showing typical activities and their sequence in the practice of the furniture design and manufacturing techniques of the present invention.

FIG. 4 is a flow diagram and matrix showing typical activities and their sequence in the practice of the furniture design and manufacturing techniques of the present invention. As noted in the right column of FIG. 4, the first general step involves creation of a selected design vocabulary. As the top bracket suggests, creating of the selected design vocabulary involves selection of beam cross sectional incremental dimensions and cross sectional shapes, selection of beam length incremental dimensions and selection of panel thicknesses to match beam cross sectional shapes.

After that, as is indicated by the second bracket, beam stock and, if desired, panel stock may be produced prior to selection of particular furniture items to be manufactured.

The third bracket indicates that furniture to be manufactured is then identified, and the specific beam and component panels needed to produce it are also identified.

In the final major activity indicated by the forth, bottom bracket, the particular furniture is produced by assembling the required components.

As the FIG. 4 flow diagram makes graphically evident, practice of the present invention begins with creation of a design vocabulary. That yields, among other benefits, a coherent, identifiable design style across all furniture items manufactured utilizing the selected design vocabulary. This also permits production of beam and panel stock at a time and in a manner that is efficient and low in cost.

FIG. 5, as noted above, illustrates a small chest of drawers 100 utilizing the above-described design approach of the present invention. As is readily apparent from FIG. 5, the corner posts 101 of FIG. are beams having a square cross section, and other beams 102 and 104 span the distance between pairs of post beams 100 and provide dividers between the drawers, drawer runners and, in the case of beams 104, frame members for panels 106.

Figure 6:
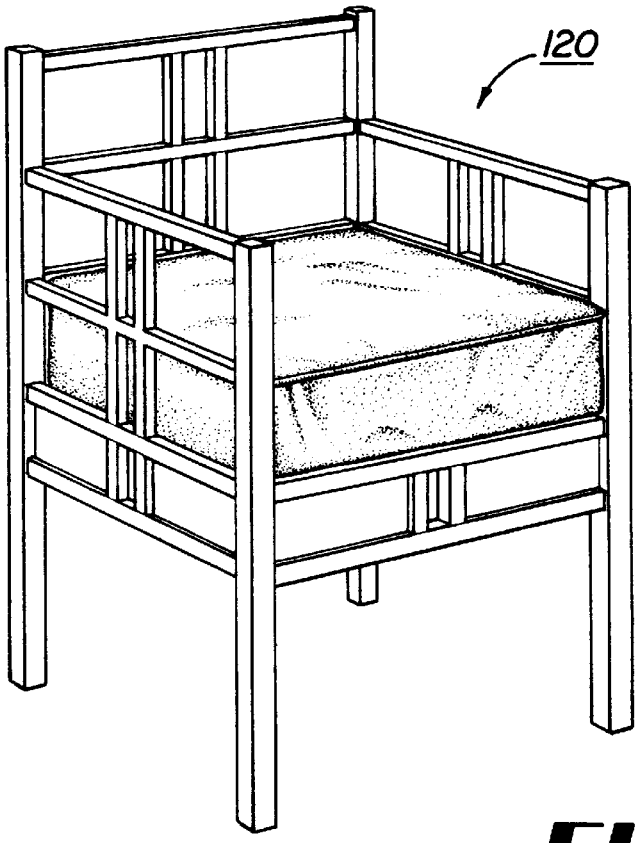
FIG. 6 is a perspective view of the front, left side and top of a chair designed in accordance with the present invention.
Figure 7:
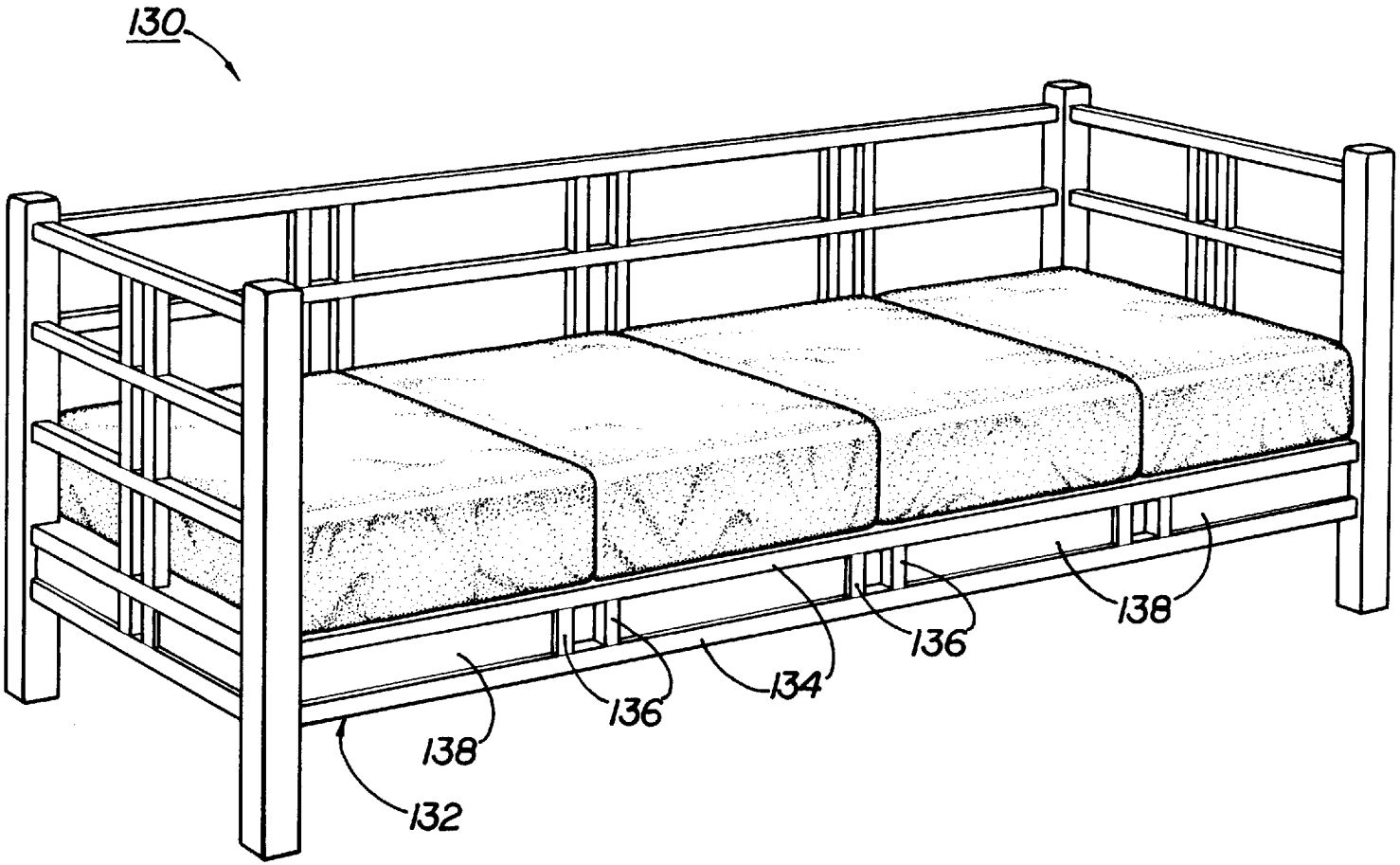
FIG. 7 is a perspective view of the front, left side and top of a sofa designed in accordance with the present invention.

FIGS. 6 and 7 illustrate a chair 120 and sofa 130, respectively, having closely similar designs. Sofa 130 is noteworthy in that a relatively light horizontal girder 132 spans the entire width of the sofa 130 yet is sufficiently strong to obviate the need for a center leg. Girder 132 may be formed by two horizontal girder beams 134 between which vertical beams 136 and panels 138 are captured. As is explained above, this "I-beam" or "H-beam" structure is capable of bearing a very substantial load normal to the longer dimension of the girder 132.

The foregoing description of the present invention is provided for purposes of explanation and illustration. Modifications may be made without departing from the scope of spirit of the invention.

I claim:

1. A method for manufacturing furniture, comprising the steps of:

(a) selecting a design vocabulary comprising a variety of graduated, substantially rectilinear cross-sectional shapes for furniture component beams, (b) manufacturing random lengths of beam stock in the previously-selected beam cross-sectional shapes, (c) selecting a particular furniture item to be built, (d) determining the lengths, numbers, and types of beams required for assembly of the particular furniture item, (e) cutting from the previously produced beam stock the lengths, types, and numbers of beams identified in the preceding step, (f) machining the beams to enable them to be joined, (g) assembling the beams by joining the previously machined portions of the beams to form the furniture item.

2. The method for manufacturing furniture of claim 1, wherein the step of manufacturing random lengths of beam stock is accomplished using molders and substantially without abrasive machining prior to the application of finish.

3. The method for manufacturing the furniture of claim 1, further comprising selecting beam length incremental dimensions when selecting the design vocabulary and determining the lengths of beams during the practice of step (d) by reference to the selected beam length incremental dimensions.

4. The method for manufacturing the furniture of claim 1, further comprising the steps of:

(x) manufacturing furniture panel material having edges and having a thickness, at least at the panel edges, which will fit into rectilinear recesses in the beams, and (y) incorporating the panels in the furniture item when assembling the beams by joining the previously machined portions of the beams.

5. A method for manufacturing furniture, comprising the steps of:

(a) selecting a design vocabulary comprising:

(1) a variety of graduated, substantially rectilinear cross-sectional shapes for furniture component beams and (2) a plurality of beam length incremental dimensions, (b) manufacturing random lengths of beam stock in the previously-selected beam cross-sectional shapes using molders and substantially without abrasive machining prior to the application of finish, (c) selecting a particular furniture item to be built, (d) determining the lengths, numbers, and types of beams required for assembly of the particular furniture item, wherein the determination of the lengths of beams required is accomplished by reference to the selected beam length incremental dimensions (e) cutting from the previously produced beam stock the lengths, types, and numbers of beams identified in the preceding step, (f) machining the beams to enable them to be joined, (g) manufacturing furniture panel material having edges and having a thickness, at least at the panel edges, which will fit into rectilinear recesses in the beams, and (h) assembling the beams and panels by joining the previously machined portions of the beams to form the furniture item and capturing the panels in rectilinear recesses in the beams.

6. An item of furniture manufactured in accordance with the method of claim 1 wherein the item includes at least two types of beams having cross-sectional dimensions that differ so that both the cross-sectional width and depth of one beam differ from the cross-sectional width and depth of the other beam.

7. An item of furniture manufactured in accordance with the method of claim 5 wherein the item includes at least two graduated types of beams having cross-sectional dimensions that differ so that both the cross-sectional width and depth of one beam differ from the cross-sectional width and depth of the other beam and wherein the panel material has panel edges that fit into rectilinear recesses in the beams and the panels are captured by beams joined to frame the panels.

8. The item of furniture of claim 6, wherein the beams are manufactured substantially without abrasive machining prior to the application of finish.

9. The item of furniture of claim 6, wherein the step of machining the beams to enable them to be joined results in:

at least one recess in a face of at least one of the beams and at least one tenon on the end of another beam to be received in the recess in the face of the one beam.

10. The item of furniture of claim 6, further comprising furniture panels having edges and having a thickness, at least at the panel edges, which fits into rectilinear recesses in at least two of the beams.

11. The item of furniture of claim 7, further comprising at least one generally horizontal girder, the girder comprising two generally parallel, generally horizontal beams that capture at least one furniture member therebetween, which furniture member acts to maintain a relatively constant distance between the two girder beams when a load is applied to the girder.

* * * * *